United States Patent [19]

Mercier

[11] Patent Number: 5,063,812

[45] Date of Patent: Nov. 12, 1991

[54] PAWL ASSEMBLY FOR MANUAL STARTING OF SMALL INTERNAL COMBUSTION ENGINES

[75] Inventor: Real L. Mercier, West Springfield, Mass.

[73] Assignee: R. E. Phelon Company, Inc., East Longmeadow, Mass.

[21] Appl. No.: 589,411

[22] Filed: Sep. 28, 1990

[51] Int. Cl.[5] ..... G05G 1/00

[52] U.S. Cl. ..... 74/575; 74/577 M; 192/42; 192/103 B; 123/185 A

[58] Field of Search ..... 74/575–578; 192/42, 103 B, 104 C, 104 B, 105 CD; 123/185 A, 185 B, 185 BA

[56] References Cited

U.S. PATENT DOCUMENTS

| | | | |
|---|---|---|---|
| 159,221 | 1/1875 | Rosebrook | 74/576 |
| 1,516,681 | 11/1924 | Palmer | 74/577 |
| 1,767,593 | 6/1930 | Laabs | 192/42 |
| 2,217,074 | 10/1940 | Obergfell | 74/576 |
| 2,487,733 | 11/1949 | Scheffer | 74/577 |
| 3,127,884 | 4/1964 | Rice | 74/577 |
| 3,252,452 | 5/1966 | Burkett et al. | 123/185 A |
| 3,656,599 | 4/1972 | Diggs | 192/42 |
| 3,906,816 | 9/1975 | Nepote | 74/575 |
| 3,943,796 | 3/1976 | Hillyer | 74/577 |
| 4,127,098 | 11/1978 | Frers et al. | 123/185 BA |
| 4,977,795 | 12/1990 | McVey | 74/577 |

*Primary Examiner*—Richard Lorence
*Assistant Examiner*—Winnie Yip
*Attorney, Agent, or Firm*—Chapin, Neal & Dempsey

[57] ABSTRACT

Improved pawl assembly for starting mechanisms of small engines mounted on the engine flywheel provided with a bore therein and includes an integrally molded, polymeric pawl, a U-shaped torsion spring and retaining means disposed in the bore of the flywheel. The pawl has a depending shank rotatably fitted into the bore of the flywheel and oppositely extending end portions. The outer end portion, or spur, is adapted to engage a fin or vane of the flywheel to orient the inner end portion, or toe, of the pawl to engage the teeth of the ratchet surface of a pulley type starter. The closed end of the torsion spring is fitted over the shank and urges the pawl to its ratchet engaging position. The spring includes leg portions fitted into the bore of the flywheel and each leg terminates in a laterally extending hook portion adpated to interfit within the retaining means disposed at the end of the bore opposite the end into which the shank is fitted. The retainer includes a slot adapted to receive and hold the hook portions of the spring therein for completing the assembly of the pawl and spring on the flywheel and for tensioning the spring.

8 Claims, 2 Drawing Sheets

PAWL ASSEMBLY FOR MANUAL STARTING OF SMALL INTERNAL COMBUSTION ENGINES

BACKGROUND OF THE INVENTION

This invention relates to pull starters for small engines and, more particularly, to mechanisms for transferring energy from the pull starter into a rotational force on a flywheel to thereby crank the engine.

Recoil starter or pull cords are generally used for cranking small engines, such as chain saws, trimmers, lawn mowers and the like. Usually, the starters include a handle secured to a cord, or lanyard, which is coiled around a pulley combined with a ratchet wheel rotatable thereby. The flywheel is generally provided with pivotable pawls adapted to engage and be driven by the ratchet wheel. When the operator pulls the starting lanyard, the pawl engages the teeth of the ratchet, causing rotation of the flywheel, thereby cranking the engine. Upon starting of the engine, the pawls will pivot, due to centrifugal force, out of engagement with the ratchet so that the starter will be uncoupled from the flywheel.

In the past, one structure for such a pawl assembly included a metallic stamping having, at one end, a foot portion for engagment with the ratchet and, at the opposite end, a spur to engage a vane of the flywheel. In addition, a constant force, coil spring served to provide a rotational force on the pawl and thus urged the pawl into engagement with the ratchet. Among the drawbacks to that structure was that, in order to rotatably mount the pawl to the flywheel, the pawl and coil spring has to be assembled together and a rivet, or ribbed pin, had to be fitted through the pawl and spring assembly and then hydraulically press-fitted into a bore in the flywheel which involved substantial labor costs during the assembly procedure.

Accordingly, the principal object of this invention is to provide a pawl and spring assembly adapted for ease of assembly onto a flywheel, without the need of tools, as was required for conventional pawl assemblies adapted to be press-fitted onto the flywheel.

The above and other objects and advantages of this invention will be more readily apparent from the following description read in conjunction with the accompanying drawings in which.

Figure 1:
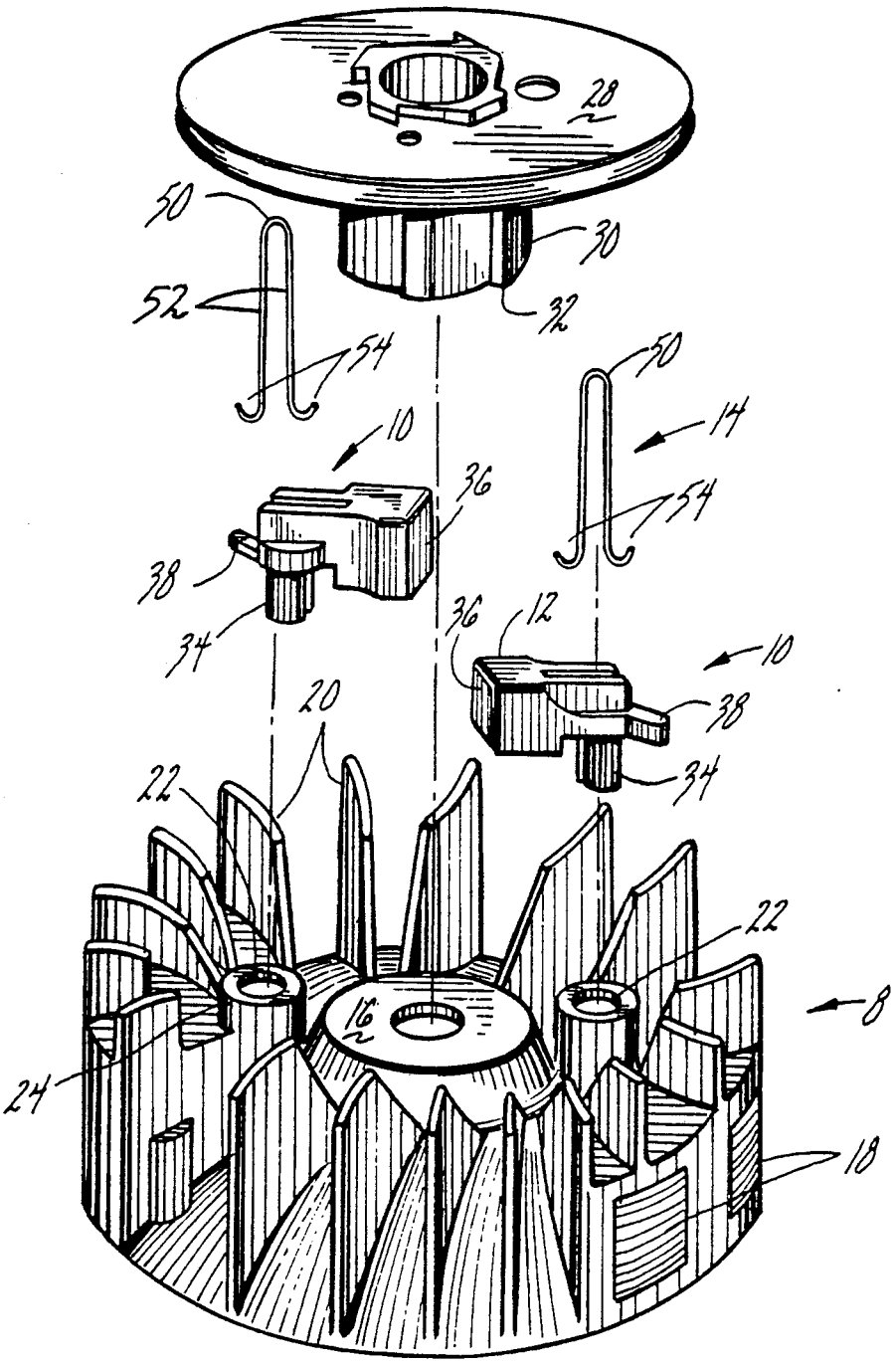
FIG. 1 is an exploded view of a flywheel construction with starter pawl and spring assembly of the type embodying this invention.

In FIG. 1 is shown a flywheel 8 for small internal combustion engines in combination with a pair of pawl assemblies 10, each of the type embodying this invention. Each pawl assembly comprises a unitary pawl 12 and a generally U-shaped torsion spring 14. The flywheel 8 may be of the type used for small engines, such as chain saws or lawn mowers, and may be fabricated by casting or molding a metallic or a polymeric material. The flywheel 8 is mounted by its hub 16 to the engine shaft (not shown) and includes a permanent magnet with pole pieces 18 used to generate engine ignition pulses in the ignition coil (not shown) of the engine. Cooling fins, or vanes 20, are formed on the outer surface of the flywheel and cylindrical bores 22 are provided for rotatably mounting the pawls 12. The vanes 20 provide means for air cooling the engine when it is running. Bores 22 are spaced diametrically on opposite sides of the hub 16 and extend inwardly from one end of the flywheel through raised bosses 24 which project from the outer surface of the flywheel 8. At the opposite end of the flywheel, bores 22 include tapered portions 25 (FIG. 3) which form a transverse slot 26 (FIG. 5) on the outer ends of which are adapted to receive and retain the free ends of spring 14. Two separate and identical pawl assemblies 10 are shown in this embodiment, although it will be understood that within the scope of this invention, any suitable number may be utilized.

Figure 2:
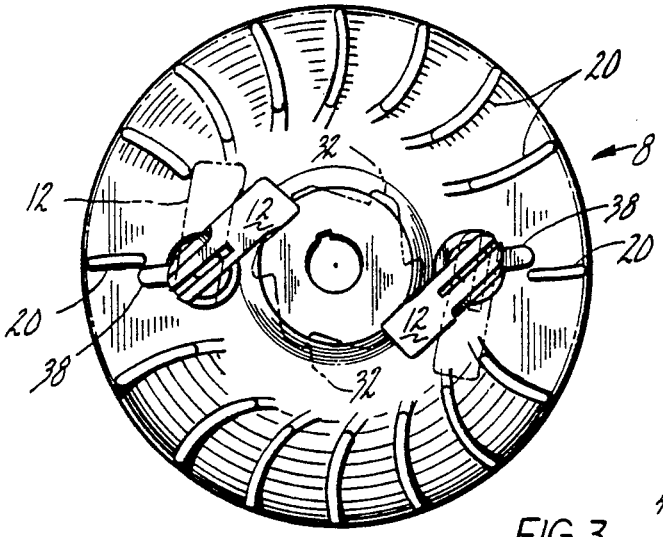
FIG. 2 is a plan view of the flywheel and pawl assembly of FIG. 1.

A pulley 28 is coaxially assembled in juxtaposition with the flywheel 8 so that the ratchet wheel 30 is engageable by the inner end, or toe, of each pawl 12. The ratchet 30 includes teeth 32 which are shaped and angled for engagement with the pawls 12 so that flywheel 8 will be driven in only one rotary direction, namely counterclockwise, as depicted in FIG. 2. When the engine begins to run, the pawls 12 will be free to "ratchet over" the teeth 32 until centrifugal force increases sufficiently to cause the pawls 12 to pivot, or swing, outwardly, as depicted in the dotted line positions of FIG. 2.

Figure 4:
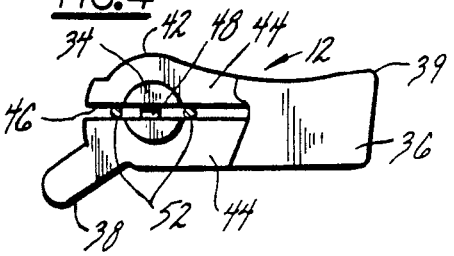
FIG. 4 is a bottom plan view of one starter pawl.

Referring generally to the figures, the pawl 12 may be composed of any suitable material and are preferably intergrally molded of a durable, high impact and heat resistant polymer, such as Nylon, Delrin and the like. The pawl 12 is in the form of a horizontally pivotable lever which includes a medial mounting portion, or shank 34, an inner end portion, or toe 36, adapted to engage the ratchet wheel 30 and an outer end portion, or spur 38, adapted to engage a vane of the flywheel 8 to thereby position the toe 36 of the pawl 12 to engage the ratchet wheel 30. The mounting portion of the pawl 12 comprises longitudinally split or bifurcated shank 34 (FIG. 4) extending downwardly from a flange 42 adapted for rotatable engagement on the outer peripheral edges of bosses 24. The inner end portion of the pawl 12 includes a generally rectangular block which forms the toe 36 of the pawl and a pair of parallel, laterally-spaced, arms 44 which define a longitudinal slot 46 adapted for receiving spring 14. A transverse web or brace 48 extends across the slot 46 between opposed portions of the arms 44, is aligned with the longitudinal axis of the shank 34, and is adapted to engage the loop, or closed end 50, of spring 14. The bifurcated shank 34 is adapted to provide access for the leg portions of the spring 14 between the two semi-circular portions of the shank, so that the spring will not inhibit the free rotational movement of the cylindrical outer surface of the shank 34 within the bore 22 of the flywheel 8.

The toe 36 of the pawl is generally in the form of a rectangular block which extends radially from the shank 34 and includes a vertical edge portion 39 adapted for driving engagment with the teeth 32 of ratchet wheel 30. The major portion of the mass of the pawls 12 is located in the block-like toe portion thereof so that centrifugal force, which results from the engine rotating the flywheel 8, will cause the pawls to pivot counterclockwise (FIG. 2).

The spur 38 extends at an oblique angle radially outward from the outer end of the pawl and when assembled onto the flywheel 8 and in contact with the adjacent vane 20 of the flywheel, 8 as shown in FIG. 2, the pawls 12 are urged in a clockwise direction by spring 14, As a result, each pawl will be oriented so that its edge 39 is engaged with the teeth 32 of ratchet wheel 30.

The torsion springs 14 may be any resilient and durable material, such as spring steel and each includes a closed end 50, generally parallel legs 52 and hooked terminal ends 54. The closed end 50 of each spring is adapted to fit over the web or cross-piece 48 of the pawl 12 with the legs 52 thereof extending downwardly in the slot 46 defined by laterally-spaced arms 44 of pawl 12 and the bifurcated shank 34. To bias the pawl 12 into engagemnt with the ratchet wheel 30, each spring 14 is pre-tensioned by twisting the hooked ends of legs 52 relative to the closed end 50 of the spring. This is automatically accomplished during axial insertion of the legs 52 of spring 14 into the bore 22 which, at its lower or inner end, is tapered as at 25 in FIG. 5 and terminates in transverse slot 26.

Figure 3:
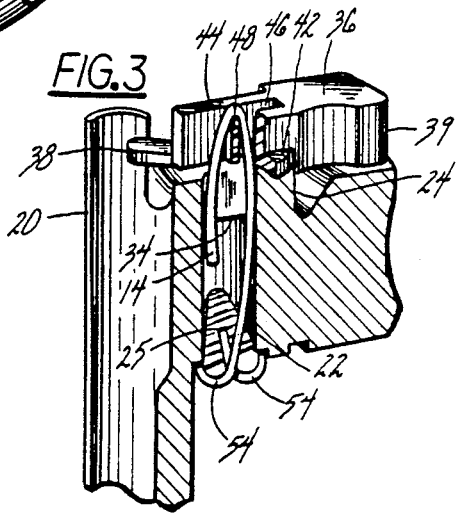
FIG. 3 is a perspective view, partially in section, showing the flywheel and pawl assembly of FIG. 1.

As will best be seen by reference to FIGS. 3–6, the lower, or inner, end of each bore 22 includes opposed sidewall portions which taper inwardly and downwardly, as at 25. In a direction transverse to the tapered sidewall, the bore 22 is not tapered, whereby the bore 22 tapers inwardly to form transverse slot 26. The locations of the opposed tapered walls 25 are selected so that slot 26 will be oriented in a general radial direction and at an oblique angle of about 30° relative the orientation of each pawl when disposed in driving engagement with the teeth 32 of ratchet wheel 30. This pawl position is illustrated in the FIG. 2 solid line showing. With this arrangement, when a spring 14 is assembled with a pawl 12 and the spring 14 and shank 34 of the pawl are inserted into bore 22, the leg portions 52 of the spring will be twisted approximately 30° by the tapered sidewalls of the bore 22 at the lower end thereof. The spring 14 is made slightly longer than the bore so that, when fully inserted, the hooked ends 54 will pass through slot 26 sufficiently so that the hooks 54 will be captured in the outer ends of slot 26, as depicted in FIG. 3. This interengagement of the hooks 54 with slot 26 serves to hold or retain the pawl and spring assembly in place on the flywheel. In addition, the legs of the spring, having been substantially twisted, will pre-tension the spring so it will urge the pawls clockwise, as seen in FIG. 2, with spurs 38 contacting the adjacent vane 20 of the flywheel. It should be noted, that the spring tension must be less than the centrifugal force which will cause the pawls 12 to rotate counterclockwise, or outwardly, from the ratchet 30 during engine rotation of the flywheel 8.

The pawls 12 may be assembled onto the flywheel 8 by simply inserting the shank 34 and spring 14 into bore 22 until the hooked ends 54 of the spring 14 are twisted by tapers 25, pass through slot 26 and snap-fit therein. With this simple assembly procedure, the spring 14, fitted over web 48, will be tensioned with respect to the hooked ends 54 to provide a torsion spring action on the pawl 12.

Figure 5:
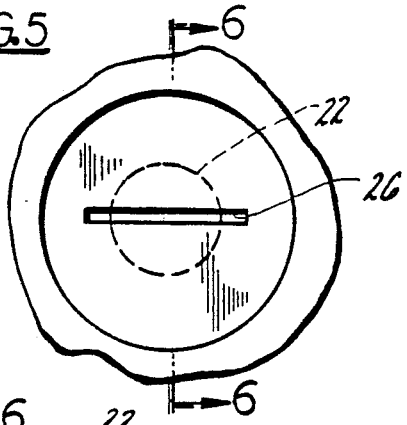
FIG. 5 is a bottom plan view of the bore of the flywheel.
Figure 6:
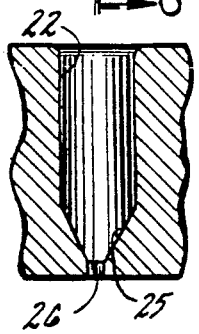
FIG. 6 is a sectional view taken along line 6—6 of FIG. 5.
Figure 7:
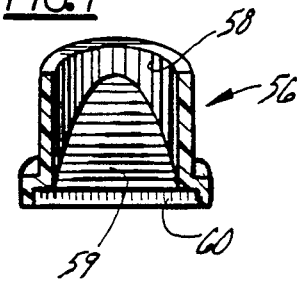
FIG. 7 is a perspective view of an alternative type of retainer which may be used in practicing this invention.

As shown in FIG. 5, a seperate retainer 56 may also be employed instead of being formed directly in the flywheel casting within the lower end of each bore 22. The retainer 56 comprises a sleeve which is adapted to be pressfitted and/or bonded into the lower end of bore 22 and includes a cylindrical bore 58, tapered sidewall surfaces 59, and a transverse slot 60. The retainer 56 may be forced by high impact, heat resistant polymer and will function in essentially the same manner as the preferred embodiment.

In operation, when the pulley 28 is rotated, such as by using a recoil, or rope-type, starter, the teeth 32 thereof engage the pawls 12 which, in turn, rotate the flywheel 8. When the engine starts to run, the pawls 12, rotating with the flywheel 8, will be pivoted by centrifugal force outwardly of the ratchet 30, as shown in phantom in FIG. 2. When the engine stops, the pawls will be rotated inwardly due to the torsional force of the spring 14 until each spur 38, once again, contacts vane 20 and the toe portion 36 of the pawls 12 engages the teeth 32 of the ratchet wheel 30 ready for the next starting sequence.

Having thus described my invention, what is claimed is:

1. In a starting mechanism for small engines having a pulley combined with a ratchet wheel rotatable with the pulley, a flywheel rotatable by the engine and at least one pawl assembly drivingly interconnecting the ratchet with the flywheel, improvement to said pawl assembly comprising an integral pawl pivotably disposed on the flywheel, a torsion spring fitted onto said pawl, said torsion spring including means for securing the pawl onto the flywheel and means for biasing said pawl into driving engagement with said ratchet wheel.

2. In a starting mechanism for small engines, an improved pawl assembly as set forth in claim 1, in which said flywheel has a bore for pivotably mounting said pawl and includes retaining means adapted to receive and to hold the torsion spring in assembled relation on the flywheel.

3. In a starting mechanism for small engines, an improved pawl assembly as set forth in claim 2, in which said pawl is molded of a high impact polymeric material and said spring is a U-shaped torsion spring closed at one end with generally parallel leg portions and hook portions at the free ends thereof, said retaining means including means for receiving and holding the hook ends of said spring.

4. In a starting mechanism for small engines, an improved pawl assembly as set forth in claim 3, in which said pawl includes a depending shank rotatably disposed in said bore and a spur extending radially from one end of the pawl and toe at the opposite end, the spur extending at an oblique angle to engage an adjacent portion of the flywheel for orienting the pawl so that its toe is drivingly engaged with said ratchet wheel.

5. In a starting mechanism for small engines, an improved pawl assembly as set forth in claim 4, in which said shank is longitudinally bifurcated to accommodate therein the legs of said torsion spring so that the legs will not interfere with the rotation of the shank within the bore.

6. In a starting mechanism for small engines, an improved pawl assembly as set forth in claim 5, in which said retaining means is disposed within the end of the bore, opposite the end in which said shank is fitted, said retaining means includes opposed, inwardly tapered wall portions which terminate in a narrow, transverse slot disposed at an oblique angle to the pawl, when the panel is positioned to engage the ratchet wheel, to pre-tension said spring to its ratchet wheel wngaging position.

7. In a starting mechanism for small engines, an improved pawl assembly as set forth in claim 6, in which the toe of said pawl is of sufficient mass so that upon ratation of the flywheel, centrifugal force resulting from said rotation will cause the toe of said pawl to pivot outwardly from its position of engagement with said ratchet when the flywheel is being driven by the engine.

8. In a starting mechanism for small engines, an improved pawl assembly as set forth in claim 7, in which said retaining means comprises a separate sleeve fitted into the lower end of said bore.

* * * * *